United States Patent [19]

Schrader

[11] 4,001,977

[45] Jan. 11, 1977

[54] ROTARY VESTIBULE BLASTING DEVICE

[75] Inventor: Donald E. Schrader, South Bend, Ind.

[73] Assignee: Wheelabrator-Frye, Inc., Mishawaka, Ind.

[22] Filed: Aug. 25, 1975

[21] Appl. No.: 607,261

[52] U.S. Cl. ..... 51/15 R; 134/79

[51] Int. Cl.[2] ..... B24C 3/14; B08B 5/00

[58] Field of Search ..... 51/8 C, 14, 15; 134/78–81, 126, 158

[56] References Cited

UNITED STATES PATENTS

| | | | |
|---|---|---|---|
| 2,160,697 | 5/1939 | Hamren | 51/14 X |
| 2,344,476 | 3/1944 | Turnbull | 51/14 |
| 2,351,272 | 6/1944 | Le Tourneau | 51/15 |
| 2,510,927 | 6/1950 | Huyett | 51/14 |

*Primary Examiner*—Gary L. Smith
*Attorney, Agent, or Firm*—McDougall, Hersh & Scott

[57] ABSTRACT

A device for continuous blast treatment of parts is disclosed. The device employs an overhead monorail conveyor for carrying parts to be treated into a blast chamber where the parts are subject to a particulate blast, as for example, abrasive treatment. At least one rotary vestibule is employed to convey the parts on the monorail into and out of the blast chamber while providing dynamic abrasive tight sealing of the entrance and exit openings to the blast chamber.

11 Claims, 5 Drawing Figures

ROTARY VESTIBULE BLASTING DEVICE

BACKGROUND OF THE INVENTION

This invention relates to the field of particulate treatment of manufactured parts. More specifically, it relates to devices for the surface treatment of parts to clean, abrade, finish or otherwise prepare the parts for their intended use. Usually such treatment devices employ an abrasive such as sand, steel shot, grit or other materials projected against the parts to be treated at velocities sufficient for the purpose intended. Thus, for example, cast parts can be deburred, peened or cleaned.

Typically, the treatment operations will be accomplished by use of an airless centrifugal blasting wheel which will project the particulate against the parts to be treated. In such an operation it is usually necessary, for the protection of personnel and for efficiency, to conduct the treating operations in a closed blast cabinet or chamber, thereby facilitating recovery and reuse of the abrasive, and protecting personnel from injury by the particulate blast. When a blast chamber is utilized, it becomes necessary to operate in a batch fashion such that a number of parts are placed into a blast chamber, the blasting operation proceeds, and then the blast chamber is emptied of the treated parts and a new batch of parts is placed in it for additional treatment.

A desirable mode of operation would provide for a continuous flow of work into and out of the blast chamber without interrupting the abrasive tight integrity of the chamber. The prior art has disclosed the use of an overhead conveyor system for carrying parts through a blast area. Blast cabinets incorporating the monorail conveyor system have employed multiple flexible curtains or mechanical hinged doors in the work passage openings. These have not been completely effective or have required a disproportionate amount of space to provide complete continuous closure. These closures are often in intimate contact with the workload resulting in rapid failure of the closure parts from wear or from elevated temperatures of the work parts. The mechanical hinged multiple door arrangements require a large number of electrical and pneumatic components for correct synchronous operation and are subject to rapid failure because of their complexity and because of abrasive fouling of the multiple points of relative movement.

The prior art also has disclosed the use of a rotary vestibule to seal a blast chamber, while at the same time providing for ingress and egress of work. In such designs the work has been suspended from hangers permanently attached to the rotating vestibule. Exposed externally from the blast cabinet are one or at the most two hangers which can be loaded and unloaded.

It is accordingly an object of the present invention to provide a blast treatment device which has the following advantages:

Unlimited number of loading and/or unloading locations;

permits locating loading and unloading stations adjacent to points of prior and following operations to minimize multiple handling of work;

permits loading and unloading to be remote from inherent noise of blast operation;

permits loading and unloading remote from exposure to random escaping shot and dust;

permits loading and unloading remote from areas of relative motion of vestibule partitions and blast enclosure;

and allows for work surge storage areas before and after treatment of work.

DETAILED DESCRIPTION

Referring now to FIGS. 1–4, the invention according to a first embodiment is disclosed. An overhead monorail conveyor system is provided which includes the monorail track 10 from which are suspended a plurality of rotatable hangers 12. In a known manner, the hangers 12 are moved, as by a chain drive, along the monorail track 10. The track can be secured to the ceiling or supported on upright supports as desired for a particular installation. The rotatable hangers 12 are attached to the monorail track at a spacing which is determined according to the length of the monorail, the size of the blast chamber, and most importantly, the dimensions of the rotary vestibule, to be discussed.

Figure 2:
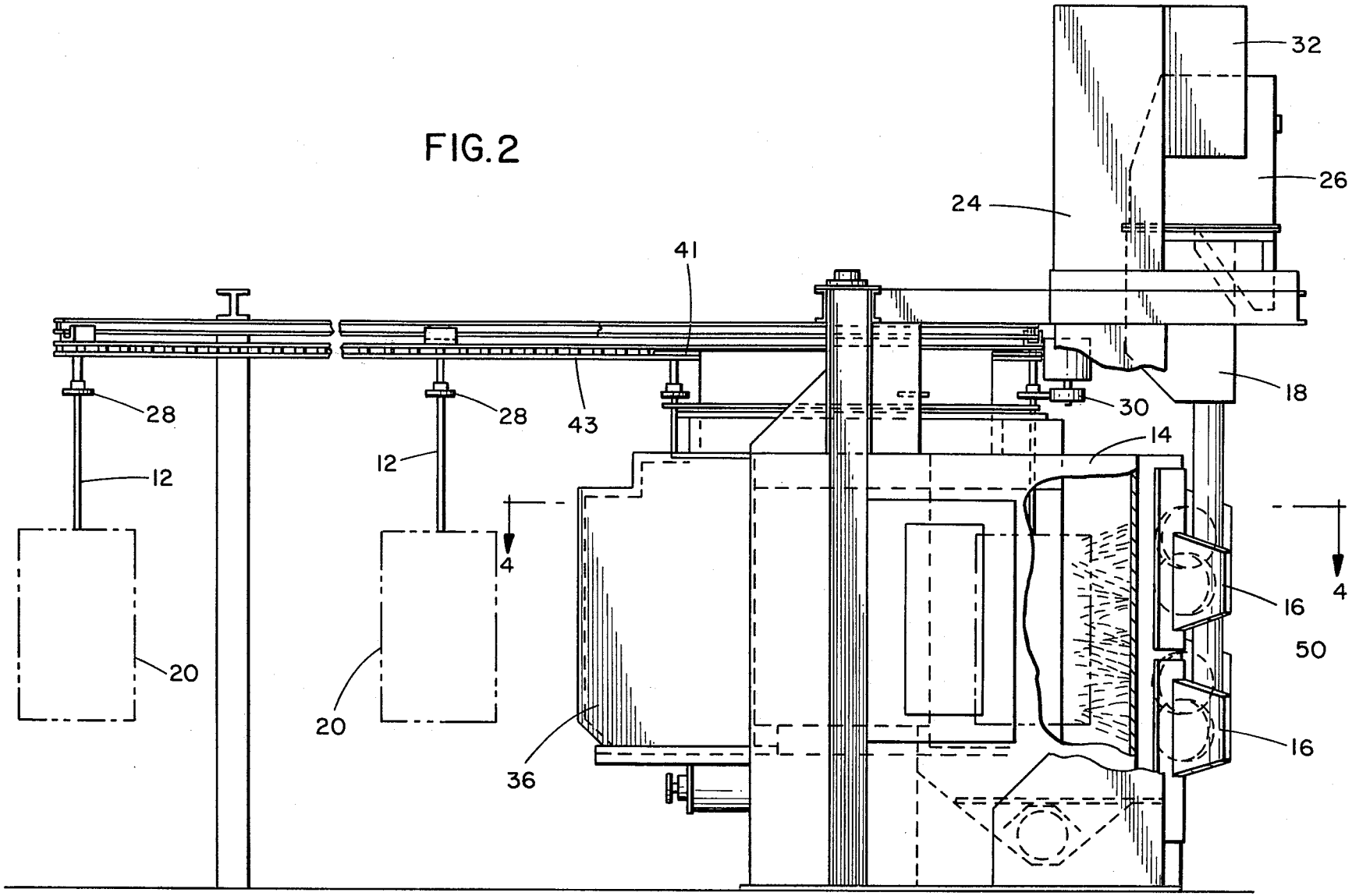
FIG. 2 is a side elevational view of the system disclosed in FIG. 1.
Figure 3:
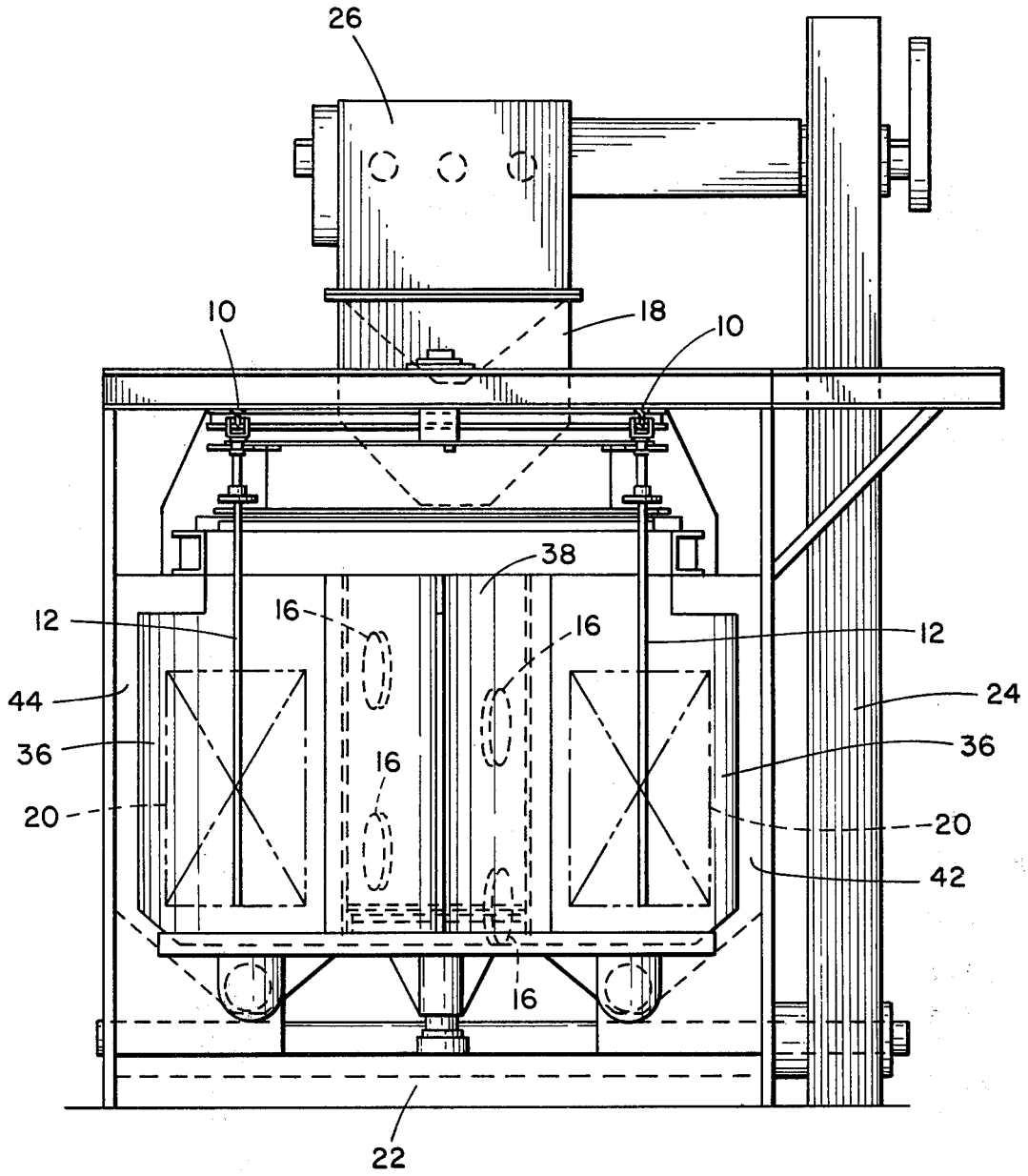
FIG. 3 is a sectional view along the lines 3—3 of FIG. 1.

The monorail 10 is operated by a motorized system for causing the hangers 12 to move along the monorail track such that the hangers 12 move into, through and out of the blast chamber 14. As best seen in FIGS. 2 and 3, the blast chamber 14 includes an abrasive projecting and recovery system. The projecting system includes a plurality of airless centrifugal wheels 16 which are motor driven and supplied with abrasive from an overhead hopper 18. In a manner well known in the art, the abrasive supplied to the centrifugal wheels is hurled outwardly therefrom due to the high speed rotation of the blades to effect the scouring, cleaning, or other desired treating of the parts to be subjected to the blast. Wheels which are suitable for this purpose are manufactured by the Wheelabrator-Frye Company of Mishawaka, Indiana.

The abrasive blast created is effective to treat parts indicated schematically at 20 (FIG. 2) which are attached to the hangers for movement on the monorail into and out of the blast chamber 14. After the abrasive is hurled at the parts which, as will be described, are rotated during the period of treatment, the spent abrasive falls to the bottom of the blast chamber. Collection means are provided, including a screw conveyor 22 which carries the spent abrasive from the bottom of the blast chamber to the boot of a belt and bucket elevator 24. Elevator 24, in a manner well known in the art, conveys the material, which includes the spent abrasive and some foreign materials from the treatment process, to an airwash separator 26 or other separation device which may include screens for separating out abrasive which has broken down to a point where it is too fine for further treatment. The separating device 26 effects a separation of the reusable abrasive from the fines, dust and other materials and recirculates the abrasive to the wheels 16 for further treatment.

Figure 1:
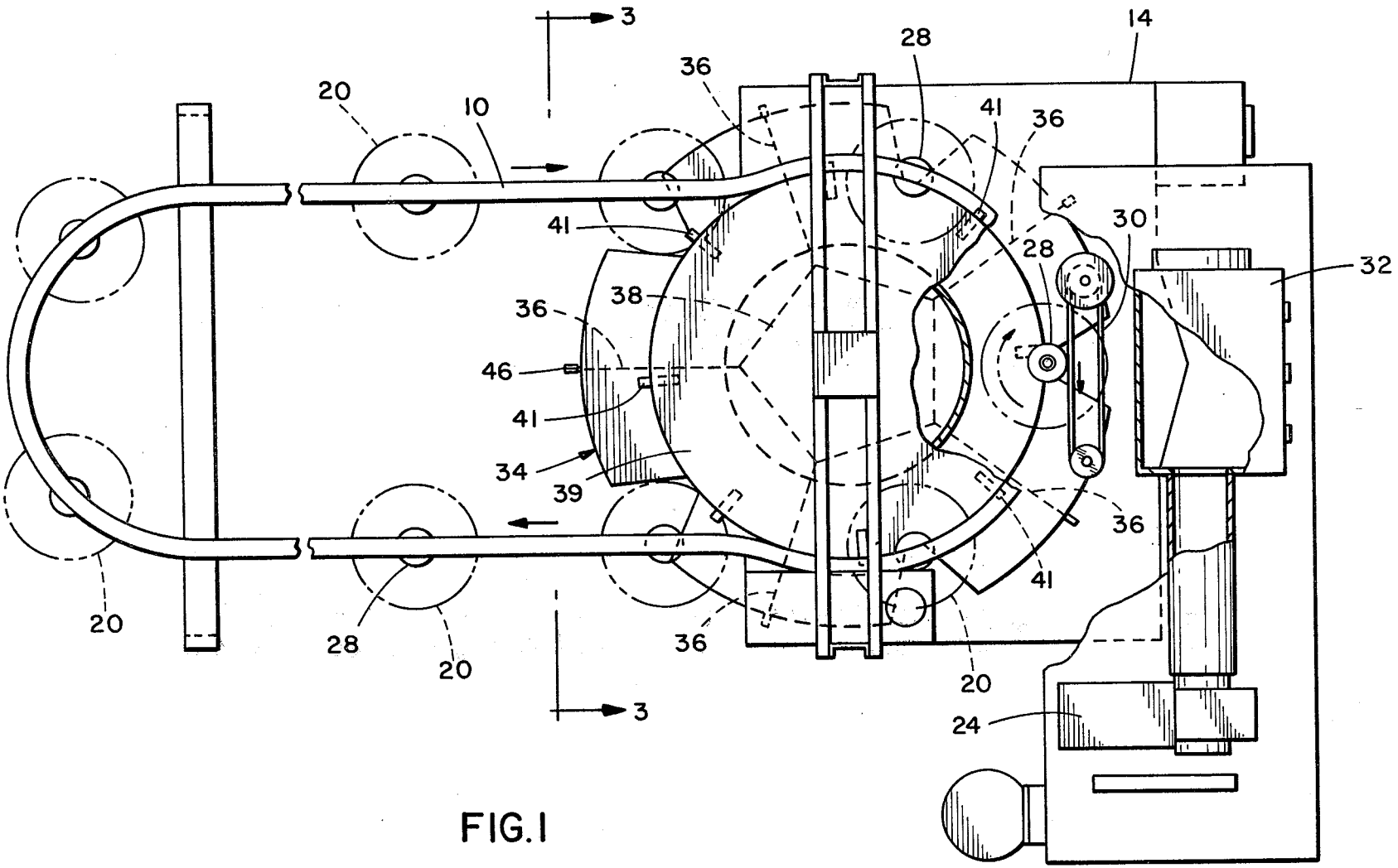
FIG. 1 is a plan view of a rotary vestibule blasting device according to a first embodiment of the invention.

Referring to FIG. 1, the means for causing the parts 20 suspended on the hangers 12 to rotate when in front of the blast area is illustrated. Each hanger 12 has mounted thereon a smooth gear or disk 28 which engages a motor-driven endless belt conveyor 30. Thus, as each hanger 12 passes into the vicinity of the belt conveyor 30, the smooth gear 28 contacts the rotating endless belt 30, causing rotation of the hanger 12 and the part 20 suspended therefrom, insuring an effective treatment of the total surface of the part 20 by the centrifugal blasting wheels 16.

One of the essential features of the present invention is the ability of the device to carry out a continuous particulate treatment operation without the need for the usual batching operations wherein the operation must be interrupted to remove finished parts and insert a new supply of unfinished parts to be treated. This continuous operation is achieved by use of a rotary vestibule which operates to keep the blast compartment 14 sealed while at the same time providing ingress and egress for each hanger 12 as it moves along the monorail 10. As will be appreciated, the spacing between the hangers 12 is determined by the dimensions of the rotary vestibule and the number and spacing of sealing partitions included thereon.

In the FIG. 1 embodiment, the rotating vestibule 34 is illustrated as having five partitions 36 extending radially outwardly from a central structure 38. The structure 38 is mounted for rotation about a vertical axis 40. It will of course be appreciated that a greater or lesser number of partitions 36 could be employed depending upon the size of the device, the desired capacity and other considerations such as the type of parts to be treated in the blast chamber 14.

Spaced around the outer periphery of the vestibule and secured to a top covering plate 39 are a plurality of projections 41. Projections 41 are bolted to the top plate 39 and extend a distance beyond the top plate for engagement with the driving chain 43 (FIG. 2) of the monorail conveyor 10. The vestibule is therefore driven by the monorail conveyor system due to the engagement of the projections 41 acting as sprockets to engage the chain. It will be apparent that the entire system can be operated off a single motorized system which drives the monorail conveyor 10 since this is effective for also rotating the vestibule 34. Alternatively, a motorized system could be provided for the rotary vestibule which would in turn drive the monorail chain system. It is also possible to drive the vestibule and monorail by independent motorized systems, but this is significantly less desirable because of the timing problems which would be associated with any tendency of the system to go out of synchronism.

Each of the partitions 36 extends outwardly from the central structure 38 to a point of sealing engagement with sealing walls 42 and 44, deployed on either side of the blast chamber 14. Desirably, the partitions 36 have a resilient sealing member 46 attached to their ends for insuring a complete and effective seal as each partition comes in contact with the sealing walls 42 and 44.

Figure 4:
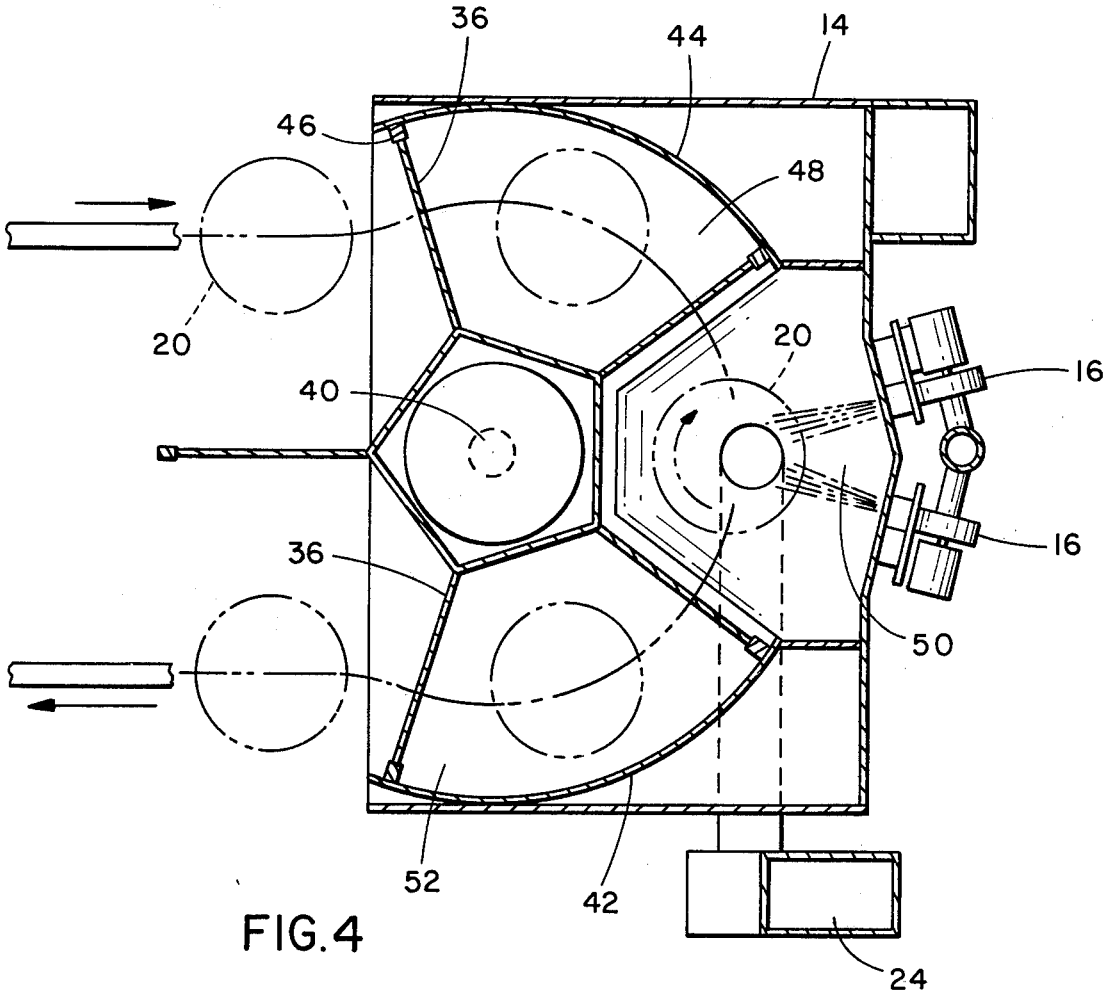
FIG. 4 is a sectional view along the lines 4—4 of FIG. 2.

As can be appreciated from FIG. 4, the spacing between the hangers 12 is selected so that as the hangers reach the vestibule they index between a pair of partitions 36. Thus, in FIG. 4, part 46 enters the vestibule area between two partitions and as the vestibule rotates, part 46 becomes sealed in the closed area 48 formed by the sealing wall 44 and the partitions 36. Upon further rotation of the vestibule, the part passes into the blasting area 50 where it is subjected to the particulate blast from the throwing wheel 16. The part is rotated in the blast area by the endless conveyor system 30 in cooperation with the smooth gear 28.

As can be appreciated, further movement of the system is effective for removing the part from the blasting area 50 to a second sealed chamber 52 formed by the partitions 36 and sealing wall 42 and finally, the part exits from the chamber 14. Appropriate spacing of the hangers provides the capability for having a hanger in each of the vestibule compartments formed between the partitions 36 so that a continuous blast cleaning operation is obtained.

After treatment the parts can be moved on the monorail to a designated removal point and new parts to be cleaned can be attached to the hangers which then proceed around and back to the blast chamber to accomplish further parts treatment.

Figure 5:
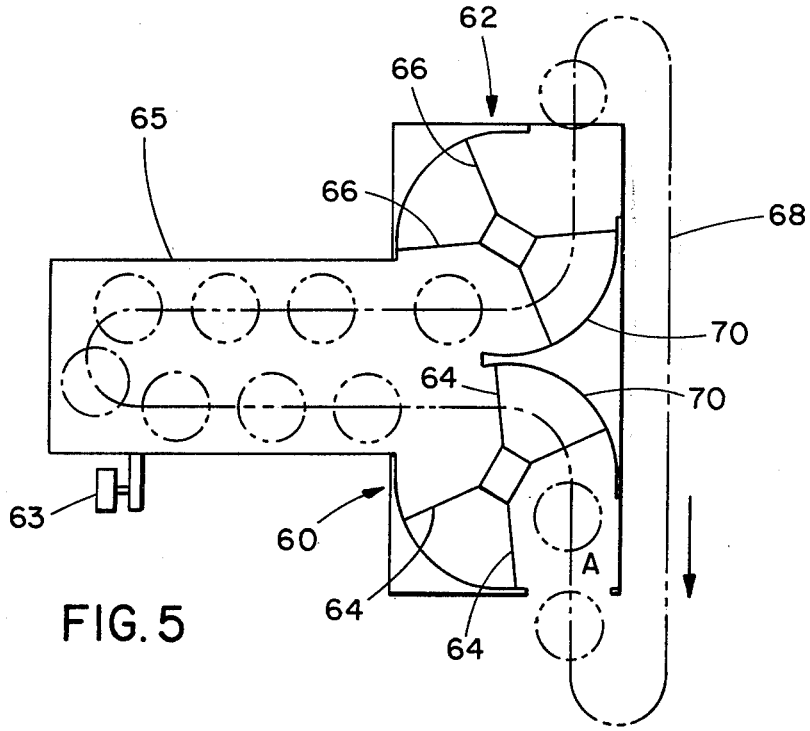
FIG. 5 is a plan view in schematic form of a second embodiment of the invention.

Referring now to FIG. 5, a second embodiment of the invention is illustrated. As has been stated earlier in this specification, the number of sealing partitions and their arrangement can be varied as desired according to the type of parts to be treated and various other considerations which are well known to those in the art. In FIG. 5 there is illustrated an arrangement in which two rotating vestibules are utilized. Vestibule 60 is an entrance vestibule while rotating vestibule 62 is an exit vestibule. The blast cabinet 64 is capable of treating a plurality of parts simultaneously, and for that purpose has particulate treatment devices 63 located at various points along the inside of the cabinet. In the design illustrated in FIG. 5, there are four partitions 64 on the entry vestibule 60. Similarly there are four partitions 66 on the exit vestibule 62. Unlike the FIG. 1 embodiment, the FIG. 5 design utilized only every other compartment for receiving a part on a monorail conveyor illustrated schematically at 68. A part enters the vestibule suspended on a hanger from the monorail at A. The part is then conveyed to a position where it is enclosed within the partition 64 and a sealing wall 70. Further rotation of the vestibule permits the part to enter the blast cabinet for subsequent treatment.

Exit from the cabinet 65 follows substantially the same procedure wherein every other compartment formed by the partition 66 receives a part and conveys it out of the blast chamber after first sealing it against sealing wall 70 to prevent the escape of particulate.

With regard to both embodiments disclosed herein, it should be noted that the rotating vestibules always rotate in the same direction, and regardless of the degree of rotation, provide a complete sealing of the blast cabinet prior to and subsequent to particulate treatment to prevent escape of abrasive from the blast cabinet. It will readily be appreciated that other designs of the rotating vestibule can be employed wherein a larger or smaller number of partitions are utilized. It is important, however, that in all cases there be a complete sealing of the part prior to its entry into the blast cabinet and a complete sealing of each compartment prior to exit from the blast cabinet.

While I have shown and described embodiments of this invention in some detail, it will be understood that this description and illustrations are offered merely by way of example, and that the invention is to be limited in scope only by the appended claims.

I claim:

1. A device for particulate treatment of parts comprising:
   a. a particulate treatment chamber having blast means therein and at least one opening thereto;
   b. conveyor means for moving parts to be treated into and out of said chamber through said opening; and
   c. a rotating vestibule for dynamically sealing each opening to said chamber to prevent particulate escape while permitting passage of parts into and out of said chamber on a continuous basis,
   d. said conveyor having a drive mechanism and said vestibule including means for engaging said drive mechanism for movement of said conveyor to rotate said vestibule and vice versa.

2. The device of claim 1 wherein said chamber has at least one sealing wall adjacent each opening, said sealing wall cooperating with said rotating vestibule to dynamically seal said chamber against the escape of particulate.

3. The device of claim 1 wherein said conveyor means is an overhead monorail type conveyor, said parts being attached thereto by downwardly extending hangers.

4. The device of claim 3 wherein said hangers are rotatable about a vertical axis so that in said blast chamber said parts may be treated over their entire surface area by rotation of said hanger, said device further including means in said blast chamber for rotating said hangers.

5. The device of claim 2 wherein said rotating vestibule includes:

a plurality of partitions extending radially outwardly therefrom each adjacent partition pair defining a compartment for receiving a part, said partitions contacting each sealing wall during rotation of said vestibule to prevent escape of particulate from said chamber.

6. The device according to claim 1 wherein said conveyor is motor driven.

7. The device according to claim 1 wherein said vestibule is motor driven.

8. The device according to claim 5 wherein a single rotating vestibule is employed and said parts enter, are treated, and exit said blast chamber while located in one of the partition compartments of said rotating vestibule.

9. The device according to claim 5 wherein two rotating vestibules are employed, a first vestibule acting as an entry vestibule, a second acting as an exit vestibule.

10. A device for particulate treatment of parts comprising:
   a. a particulate treatment chamber having blast means therein and at least one opening thereto;
   b. conveyor means for moving parts to be treated into and out of said chamber through said opening, said conveyor means including an overhead monorail type conveyor with said parts being attached thereto by downwardly extending hangers;
   c. a rotating vestibule for dynamically sealing each opening to said chamber to prevent particulate escape while permitting passage of parts into and out of said chamber on a continuous basis;
   d. said conveyor has a chain drive and said vestibule includes sprocket means for engaging said chain drive whereby movement of said conveyor is effective for rotating said vestibule and vice versa.

11. A device for particulate treatment of parts comprising:
   a. a particulate treatment chamber having blast means therein and an opening thereto;
   b. an overhead conveyor system for moving parts suspended therefrom into, through and out of said chamber through said opening; and
   c. a rotating vestibule having a plurality of sealing partitions extending radially outwardly therefrom and driven by said conveyor system located at said opening to dynamically seal said chamber by sequential engagement of said partitions with the chamber to prevent escape of particulate while permitting entry, treatment and exit of said parts located in the space between adjacent partitions.

* * * * *